US005363270A

United States Patent [19]

Wahba

[11] Patent Number: 5,363,270

[45] Date of Patent: Nov. 8, 1994

[54] RAPID RESPONSE DUAL COIL ELECTROMAGNETIC ACTUATOR WITH CAPACITOR

[75] Inventor: Brent J. Wahba, Honeoye Falls, N.Y.

[73] Assignee: General Motors Corporation, Detroit, Mich.

[21] Appl. No.: 946,704

[22] Filed: Sep. 18, 1992

[51] Int. Cl.[5] ..... H01H 47/02

[52] U.S. Cl. ..... 361/155; 335/177; 361/194; 361/210

[58] Field of Search ..... 361/154–156, 361/194, 210, 206; 123/490; 335/177, 178

[56] References Cited

U.S. PATENT DOCUMENTS

| | | | |
|---|---|---|---|
| 2,883,976 | 4/1959 | Woodward et al. | 123/119 |
| 3,427,521 | 2/1969 | Goldstein | 361/155 |
| 3,456,164 | 7/1969 | Sternberg | 361/155 |
| 3,568,008 | 3/1971 | Tanimura | 361/155 |
| 3,587,547 | 6/1971 | Hussey et al. | 123/139 |
| 3,665,899 | 5/1972 | Nagy | 123/119 |
| 3,754,167 | 8/1973 | Noguchi | 361/155 |
| 3,942,485 | 3/1976 | Suda et al. | 123/32 AE |
| 4,154,198 | 5/1979 | Hoshi | 123/32 EF |
| 4,215,383 | 7/1980 | Boyd et al. | 361/155 |
| 4,218,669 | 8/1980 | Hitchcock et al. | 335/258 |
| 4,225,898 | 9/1980 | Weber et al. | 361/154 |
| 4,234,903 | 11/1980 | Harper | 361/154 |
| 4,254,653 | 3/1981 | Casey et al. | 73/3 |
| 4,338,651 | 7/1982 | Henrich | 361/154 |
| 4,355,619 | 10/1982 | Wilkinson | 123/490 |
| 4,604,675 | 8/1986 | Pflederer | 361/155 |
| 4,830,333 | 5/1989 | Watson | 251/129.18 |
| 4,903,669 | 2/1990 | Groff et al. | 123/478 |
| 4,925,112 | 5/1990 | Wahba | 239/585 |
| 4,933,805 | 6/1990 | Calfus | 361/152 |
| 4,949,904 | 8/1990 | Bata et al. | 239/5 |

*Primary Examiner*—A. D. Pellinen
*Assistant Examiner*—Richard Elms
*Attorney, Agent, or Firm*—Mark A. Navarre

[57] ABSTRACT

An electromagnetic actuator having an integral capacitor and secondary coil for reducing opening and closing response times without the need for switching circuits. The secondary coil produces a magnetic field during energization which aids the primary coil in opening the actuator. A capacitor progressively reduces the current flow through the secondary coil as it charges up. During deenergization, the capacitor discharges through the secondary coil, producing a magnetic field which opposes the primary coil's residual magnetic field and aids the closing of the actuator.

3 Claims, 2 Drawing Sheets

RAPID RESPONSE DUAL COIL ELECTROMAGNETIC ACTUATOR WITH CAPACITOR

This invention relates to a dual coil electromagnetic actuator having an integral capacitor which improves armature opening and closing response times.

BACKGROUND OF THE INVENTION

Electromagnetic actuators contain a cylindrical coil of insulated wire called a solenoid (hereinafter referred to as a coil). Energization of a coil by a DC voltage source creates a steady current flow through the coil which produces an axial magnetic field. The direction of the magnetic field is dependent upon the direction in which the coil conductor is wound and the direction of the current flow through the coil.

Electromagnetic actuators also contain a movable ferromagnetic component called an armature. The armature is located within the magnetic field and is subjected to a force, created by the field, which is proportional to the strength of the field. This force causes the armature to move in the same direction as the magnetic field.

Deenergization of a coil (removing the DC voltage source) interrupts the current flow. As a result, the magnetic field collapses and the force dissipates. Typically, the armature is returned to its original position by means of a spring.

The time it takes an armature to complete its movement in the direction of the magnetic field upon energization of the coil and the time it takes the armature to return to its original position upon deenergization of the coil are hereinafter referred to as the armature opening and closing response times, respectively.

Electromagnetic actuators are used in numerous applications requiring rapid armature response times, particularly in the area of fuel injectors for internal combustion engines. Rapid opening and closing responses improve the linear flow range of the injector and enable more precise fuel delivery.

An armature's response is affected by several factors, most notably the strength of the magnetic field to which it is subjected. The stronger the field, the greater the force acting upon the armature and the faster the opening response. Since the strength of a magnetic field is proportional to the current flow through the coil, one possible approach for improving the opening response is to increase the current flow through the actuator coil. This would, however, adversely impact the closing response since a stronger field also takes longer to collapse upon deenergization. Maintaining the additional coil current would also increase the overall power consumption of the actuator.

The affects upon the closing response could be minimized by using a switching circuit to boost the coil current only until the armature has reached the open position. The additional magnetic field strength supplied by the increased coil current is not required to maintain the actuator in the open position. This would improve the opening response time by creating a stronger initial magnetic field. In addition, by eliminating the problems associated with a stronger field to collapse upon deenergization, the closing response would not be adversely affected. Unfortunately, a switching circuit is required to turn the current boost on and off at the appropriate times, adding to the expense and complexity of operating the actuator.

An alternative approach might include the addition of a second coil in the actuator. The second coil could be used to supplement the magnetic field of the main actuator coil during energization and thereby improve the opening response. Conversely, it could be configured to assist the breakdown of the residual magnetic field in the main actuator coil during deenergization and improve the closing response. In either case, a switching circuit is required.

SUMMARY OF THE PRESENT INVENTION

The present invention is directed to an improved electromagnetic actuator having an integral capacitor which works in conjunction with an additional (secondary) coil to reduce armature response times, both opening and closing, without the need for switching circuits. The secondary coil supplements the primary actuator coil during energization, strengthening the actuator's magnetic field and improving the opening response. The capacitor charges up during energization, progressively reducing the current flow through the secondary coil as the armature moves to the open position. This conserves power since the additional field strength supplied by the increased current flow is not required to maintain the armature in the open position. Upon deenergization, the capacitor discharges back through the secondary coil, creating a reverse magnetic field which aids the breakdown of the primary coil's residual magnetic field and improves the closing response.

Despite the initial increased current flow during energization, the faster opening and closing response times of the armature enables the duration of the actuator's operation to be reduced for delivery of the same amount of fuel. This results in the added benefit of no additional power consumption.

In the illustrated embodiments, the actuator of this invention is described in the context of a fuel injector for an internal combustion engine. The availability of a means for improving injector response times will improve the linear flow range of the injector and enable more precise fuel delivery.

DETAILED DESCRIPTION OF THE PREFERRED EMBODIMENT

Figure 1:
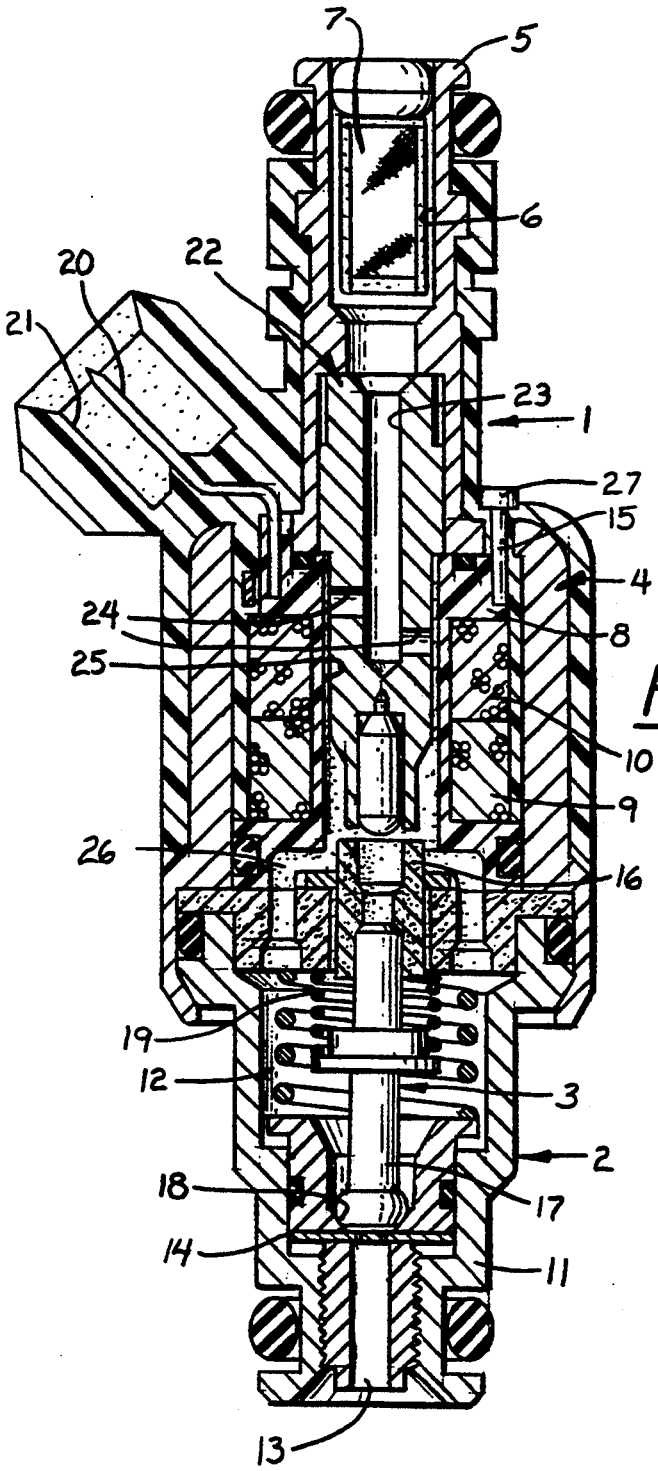
FIG. 1 is a longitudinal cross-sectional view of an electromagnetic fuel injector with a secondary coil and capacitor in accordance with the invention herein.

FIG. 1 illustrates a typical electromagnetic fuel injector for a gas-operated internal combustion engine, constructed in accordance with this invention. The injector includes, as major components thereof, an upper solenoid stator assembly 1 and a lower nozzle assembly 2 with an armature/valve 3 operatively positioned therein.

The solenoid stator assembly 1 includes a solenoid body 4 having an upper inlet tube portion 5. The inlet tube portion 5, comprised of an inlet fuel chamber 6 having a fuel filter 7 mounted therein, is adapted to be suitably connected to a source of low pressure fuel.

The solenoid stator assembly 1 further includes a stationary pole piece 22, a spool-like tubular bobbin 8 about which are coaxially wound a primary solenoid coil 9 and secondary solenoid coil 10. A pair of connecting leads 15, only one being shown in FIG. 1, connect a capacitor 27 to the primary 9 and secondary coils 10 as shown in FIG. 2.

Figure 2:
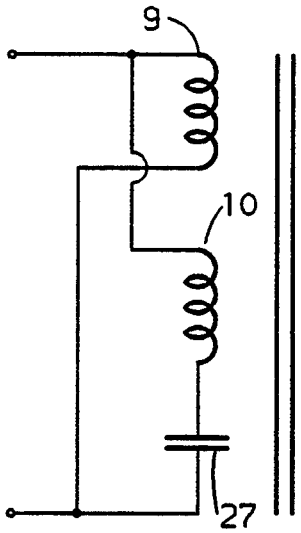
FIG. 2 illustrates the electrical circuit diagram of an electromagnetic fuel injector's primary coil, similarly wound secondary coil and capacitor configured to improve the injector's opening and closing response times.

A pair of terminal leads 20, only one being shown in FIG. 1, are each operatively connected at one end to the primary coil 9, secondary coil 10 and capacitor 27 as shown in FIG. 2. Each such lead has its other end extending up through a terminal socket 21 for connection to a suitable source of electrical power.

The nozzle assembly 2 includes a nozzle body 11 and a spring/fuel supply cavity 12. The nozzle assembly 2 further includes a tubular spray tip 13, an orifice director plate 14 and an armature/valve member 3. The armature/valve member 3 includes a tubular armature 16 and a valve element 17 having a lower end portion for engagement with the valve seat 18. The armature/-valve member 3 is normally biased in a seating engagement with the valve seat 18 by a valve return spring 19.

The solenoid stator pole piece 22 is provided with a blind bore defining an inlet passage portion 23 which at one end is in flow communication with the inlet fuel chamber 6. The other end of the inlet passage 23 is in flow communication via radial ports 24 with an annulus fuel cavity 25 formed by the diametrical clearance between the reduced diameter lower end of the pole piece 22 and the bobbin 8. The fuel cavity 25 is in flow communication, through an annular recessed cavity 26, with the spring/fuel cavity 12.

When the armature valve member 17 is electromagnetically biased in a non-seating engagement, fuel travels from the spring/fuel supply cavity 12 through the orifice plate 14 and out the tubular spray tip 13.

Referring to FIG. 1, the primary coil 9 is wound so as to produce, upon application of a DC voltage source to the terminal leads 20, a magnetic field which forces the armature 3 in a direction opposing the bias created by the valve return spring 19, thereby unseating the valve element 17 and permitting fuel to escape from the spring/fuel supply cavity 12 through the orifice plate 14 and out the tubular spray tip 13. The strength of the magnetic field and the force which it produces is proportional to the current flow through the primary coil 9.

FIG. 2 illustrates the electrical configuration of the injector's primary coil 9, secondary coil 10 and capacitor 27. The secondary coil 10 is wound coaxially with, and in the same direction as, the primary coil 9. The secondary coil 10 is also connected in series with a capacitor 27, forming an electrical branch which is further connected in parallel with the primary coil 9. The secondary coil 10 is energized by the same DC voltage source as the primary coil 9 and with a similar polarity.

The operation of the fuel injector consists of three distinct cycles: energization, holding and deenergization. During the energization cycle, the armature 3 is moved from its closed position to its open position. During the holding cycle, the armature 3 is maintained in the open position. Finally, during the deenergization cycle, the armature 3 is returned to its closed position.

Figure 3:
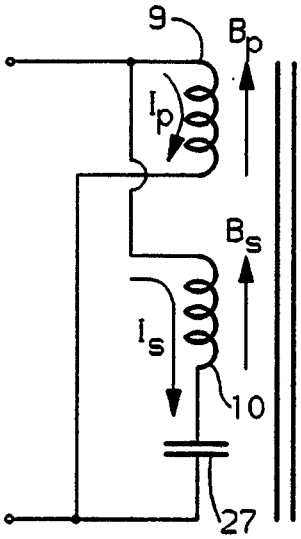
FIG. 3 illustrates the existence and direction of the injector currents and magnetic fields during the energization cycle.

FIG. 3 illustrates the existence and direction of the currents and magnetic fields during the energization cycle. Referring to FIG. 3, prior to energization there is no current flow through the primary coil 9 or secondary coil 10 and therefore no magnetic fields. At the moment of energization, currents Ip and Is begin to flow through the primary coil 9 and secondary coil 10, producing increasing additive magnetic fields Bp and Bs, respectively. Current Ip and magnetic field Bp will continue to increase until they reach their maximum values, at which point they remain constant until deenergization. Current Is and magnetic field Bs will also continue to increase, and capacitor 27 will begin to charge. However, the presence of capacitor 27 in series with the secondary coil 10 will result in current Is being progressively reduced from the moment it reaches its maximum value, thereby removing the secondary coil 10 from the circuit.

Figure 4:
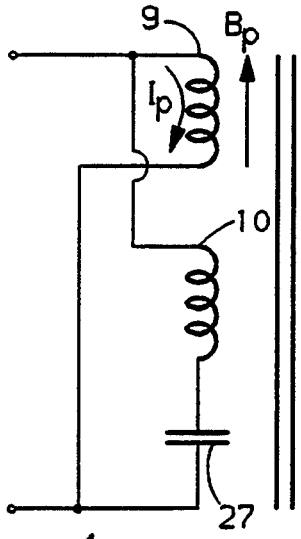
FIG. 4 illustrates the existence and direction of the injector currents and magnetic fields during the holding cycle.

FIG. 4 illustrates the existence and direction of the currents and magnetic fields during the holding cycle. Referring to FIG. 4, current Ip and magnetic field Bp remain at a constant, maximum value. The capacitor 27 is fully charged and acts as an open circuit.

From the standpoint of the armature 3, magnetic field Bp will produce a force causing the armature 3 to move in the direction of its open position. Magnetic field Bs will produce a force in the same direction as magnetic field Bp, aiding the movement of the armature 3 to its open position. After the armature 3 has reached its open position, magnetic field Bs will dissipate, leaving magnetic field Bp to maintain the armature 3 in its open position. This results in initially subjecting the armature 3 to a greater force, thereby moving the armature 3 faster and decreasing its opening response time. Once open, the elimination of magnetic field Bs reduces needless power consumption since the added strength provided by the secondary coil 10 is not required to hold the armature 3 in its open position.

Figure 5:
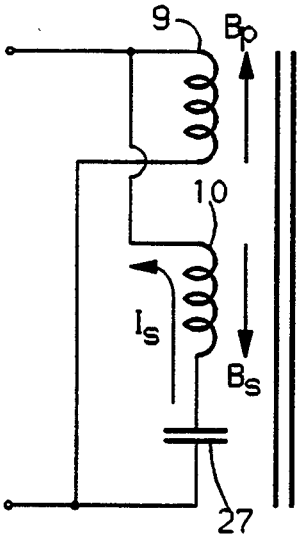
FIG. 5 illustrates the existence and direction of the injector currents and magnetic fields during the deenergization cycle.

FIG. 5 illustrates the existence and direction of the currents and magnetic fields during the deenergization cycle. Referring to FIG. 5, upon deenergization, current Ip is interrupted. The residual magnetic field Bp in the primary coil 9 will begin to collapse. Although collapsing, it still maintains the same direction and, therefore, will oppose the return of armature 3 to its closed position. Occurring simultaneously upon deenergization, the stored energy in capacitor 27 will discharge, resulting in current Is flowing in the reverse direction through the secondary coil 10. This reverse current Is will produce a magnetic field Bs in the opposite direction as that produced during energization. Magnetic field Bs will produce a force opposing the force created by the collapsing magnetic field Bp and aiding spring 19 in returning armature 3 to its closed position, thereby moving the armature 3 faster and reducing its closing response time.

Despite having a greater current flow (Ip+Is) during the energization cycle than in the absence of the secondary coil 10 and capacitor 27 (Ip only), there is no overall increased power consumption. The decrease in the opening and closing response times results in a shorter energization period for delivery of the same amount of fuel.

Figure 6:
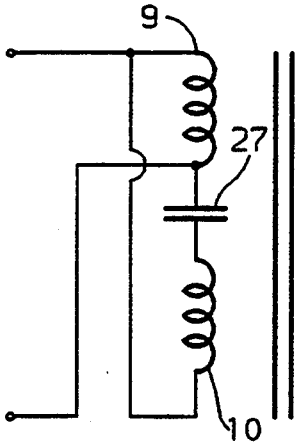
FIG. 6 illustrates the electrical circuit diagram of an electromagnetic fuel injector's primary coil, reverse wound secondary coil and capacitor configured to improve the injector's opening and closing response times.

An alternative embodiment of this invention is shown in FIG. 6. In this connection scheme, the secondary coil 10 is wound in the reverse direction as the primary coil 9 and is connected to the same energization source but with a polarity opposite that of the primary coil 9. The fields produced and the affects on the armature response times are identical as those detailed above.

While this invention has been described in reference to the illustrated embodiments, it will be understood that various modifications will occur to those skilled in the art, and that actuators incorporating such modifications may fall within the scope of this invention, which is defined by the appended claims.

The embodiments of this invention in which an exclusive property or privilege is claimed are defined as follows:

1. An electromagnetic actuator, comprising:

a movable armature;

a means for developing a mechanical force which biases said armature toward a first position;

a primary coil disposed in respect to said armature, effective when energized to develop a primary electromagnetic force in opposition to said mechanical force, moving said armature from said first position to a second position;

a capacitor; and a secondary coil connected in series with said capacitor, said capacitor regulating the flow of current through said secondary coil, said series-connected secondary coil and capacitor connected in parallel with said primary coil and effective:

(1) upon energization of said primary coil to develop a first electromagnetic force which aids said primary electromagnetic force in moving said armature from said first position to said second position, said capacitor charging up as it progressively reduces current flow through said secondary coil, said capacitor thereafter functioning as an open circuit until deenergization of said primary coil, and (2) upon deenergization of said primary coil said capacitor discharging a transient current flow through said secondary coil to develop a second electromagnetic force which opposes a residual of said primary electromagnetic force and aids said mechanical force in moving said armature from said second position to said first position.

2. The actuator set forth in claim 1, wherein said secondary coil is wound coaxially with and in the same direction as said primary coil, said secondary coil having the same polarity as said primary coil.

3. The actuator set forth in claim 1, wherein said secondary coil is wound coaxially with and in the reverse direction as said primary coil, said secondary coil having a reverse polarity as said primary coil.

* * * * *